United States Patent [19]

Mulder

[11] Patent Number: 4,715,535

[45] Date of Patent: Dec. 29, 1987

[54] POWDER SPRAY GUN

[75] Inventor: Douglas C. Mulder, Wellington, Ohio

[73] Assignee: Nordson Corporation, Amherst, Ohio

[21] Appl. No.: 856,758

[22] Filed: Apr. 28, 1986

[51] Int. Cl.[4] ..... B05B 7/14

[52] U.S. Cl. ..... 239/1; 239/432; 239/521; 239/697; 239/704

[58] Field of Search ..... 239/432, 434, 697, 698, 239/434.5, 654, 704, 655, 524, 521, 518, 504, 505; 118/308, 309, 311; 406/144, 153, 157, 193; 222/630, 636, 637

[56] References Cited

U.S. PATENT DOCUMENTS

| | | | |
|---|---|---|---|
| 1,835,603 | 12/1931 | Kincaid | 406/153 X |
| 3,069,100 | 12/1962 | Schuler | 239/524 |
| 3,425,601 | 2/1969 | Fry | 406/157 X |
| 3,425,749 | 2/1969 | Smith | 406/191 |
| 3,537,755 | 11/1970 | Schmidt | 406/193 X |
| 3,746,254 | 7/1973 | Duncan et al. | 406/144 X |
| 3,795,348 | 3/1974 | Vertue | 406/153 |
| 3,870,232 | 3/1975 | Lacchia | 239/318 X |
| 3,881,653 | 5/1975 | Birckhead | 239/698 |
| 4,215,648 | 8/1980 | Stamets et al. | 118/622 |
| 4,259,923 | 4/1981 | Breen | 118/622 |
| 4,399,945 | 8/1983 | Ruud | 239/690 |
| 4,543,274 | 9/1985 | Mulder | 427/197 |

FOREIGN PATENT DOCUMENTS

| | | | |
|---|---|---|---|
| 1203832 | 1/1960 | France | 239/434 |

*Primary Examiner*—Duane A. Reger
*Assistant Examiner*—Kevin Patrick Weldon
*Attorney, Agent, or Firm*—Wood, Herron & Evans

[57] ABSTRACT

A powder spray gun for applying particulate powder material onto a surface includes a gun body having a venturi transfer pump which receives air-entrained particulate powder material from a supply conduit and distributes the powder for discharge into a discharge conduit connected to the gun body. A spray head formed with a powder discharge slot is mounted to said discharge conduit. The discharge conduit is formed with a bend, preferably of about 90°, to concentrate the powder material along an outer wall formed by the bend for delivery in a concentrated stream to the spray head. A deflector is preferably mounted within the discharge conduit to direct the concentrated powder stream into the spray head in a predetermined manner. The powder discharge slot, which has a predetermined width and is formed by angled side walls meeting at an apex, receives the concentrated powder stream from the discharge conduit and sprays the powder in a wide, uniform spray pattern onto a surface.

17 Claims, 4 Drawing Figures

POWDER SPRAY GUN

BACKGROUND OF THE INVENTION

This invention relates to powder spray systems, and, more particularly, to a powder spray gun which can apply a wide pattern of particulate powder material upon a surface to be coated in a repeatable manner.

Particulate powder coating materials are commonly used to coat or paint objects in industrial finishing applications. In such applications, a particulate powder material such as epoxy, polyester or porcelain frit is conveyed to an applicator gun while entrained in an air stream and is sprayed from the nozzle of the gun onto a target surface or substrate. Conventionally the target substrate having powder loosely adhered thereto is then heated to melt the powder so that when the melted powder cools, it is permanently adhered to the substrate.

Powder spray guns used for spraying particulate powder materials generally include a barrel and a nozzle connected to one and of the barrel with a powder delivery passageway extending through the barrel. Particulate powder entrained in a stream of air flows through feed lines into the powder delivery passageway of the barrel from which it is sprayed through the nozzle onto the target surface to be coated.

The nozzles employed in prior art powder spray guns spray the particulate powder material along an axis generally parallel to the direction of flow of the powder through the powder delivery passageway in the gun barrel. The nozzle may be formed with a slot to produce a fan-shaped spray pattern, such as the Model 4A gun sold by the assignee of this invention, or, it may be provided with a deflector mounted exteriorly of the gun to deflect the stream of powder into a conical-shaped spray pattern as in U.S. Pat. No. 4,561,380.

One problem with prior art powder spray guns and nozzles is that it is difficult to obtain a repeatable, uniform spray pattern of particulate powder material upon the surface to be coated. This is particularly true in nonelectrostatic applications where an electrostatic field is not set up between the gun and workpiece to influence and encourage more uniform coating of the workpiece. It has been found that the particle density or concentration at one portion of the spray pattern may vary substantially from the particle density at another portion of the pattern. In addition, the particle density within the spray pattern may vary with time during a single spraying operation or run. It is believed that this uneven distribution of particulate powder material within the spray pattern is caused by the random and varying distribution of powder particles within the feed lines and powder delivery passageways upstream of the gun nozzle. Moreover, it has been observed that movement of the feed lines during or between spraying operations can cause a change in particle distribution within the spray pattern.

Another problem with prior art powder spray guns concerns the pattern typically produced by prior art powder spray nozzles having slotted discharge orifices. Generally these slotted nozzles spray a flat fan pattern which has a nominal rectangular shape when it strikes the target surface. A closer inspection of the spray pattern produced by these prior art flat spray guns reveals, however, that "tails" or enlarged areas are produced at the ends of the spray pattern so that the overall pattern resembles a dog bone or barbell.

Another limitation experienced with prior art powder spray guns utilizing a slotted nozzle is that the effective width of the spray pattern is limited to about 18 inches. If a wider area must be covered, the spray patterns must be overlapped and this can result in streaking on the coated product caused by increased concentrations of the particulate powder material upon the surface to be coated at the point of pattern overlap.

A further disadvantage of prior art powder spray systems is that the velocity of the powder stream dispensed from the gun cannot be easily varied without varying the flow rate of the powder.

SUMMARY OF THE INVENTION

It is therefore among the objects of this invention to provide a consistent, repeatable distribution of particulate powder material within a spray pattern dispensed from a powder spray gun, and, in the preferred embodiment, to produce a pattern with substantially uniform particle distribution across its width. The preferred pattern produced by this gun also has tapered distribution of powder at the ends of the pattern to permit overlapping of the end of one spray pattern with an adjacent spray pattern without excessive buildup of powder in the overlap which could produce streaks. The invention is also intended to produce spray patterns having relatively large widths so that pattern overlap will normally not be required. The invention also provides a convenient mechanism for varying the velocity of the powder stream dispensed from a powder spray gun.

These objectives are accomplished according to the practices of this invention in a powder spray gun including a discharge conduit formed with a band which is connected to a spray head having a powder discharge slot terminating in a spray orifice. Air-entrained particulate powder material is concentrated along the outer wall of the bend in the discharge conduit due to centrifugal force and is directed into the discharge slot of the spray head in a predetermined manner for dispersion in a repeatable spray pattern from the spray orifice onto a target surface.

In another aspect of this invention, a deflector is mounted within the discharge conduit upstream from the powder discharge slot in the spray head. The purpose of the deflector is to direct the concentrated stream of particulate powder material into the powder discharge slot in the spray head in a predetermined manner to obtain a repeatable spray pattern. In a presently preferred embodiment, the deflector is wedge-shaped and has a concave front surface at the powder discharge slot which distributes the powder stream so that the powder fans out evenly across the powder discharge slot and is discharged in a uniformly distributed pattern from the spray orifice. The deflector can be formed in other shapes to distribute the powder stream in other desired ways across the powder discharge slot to obtain patterns sprayed from the spray orifice having different, but repeatable, particle distributions.

The powder spray gun of this invention includes a gun body having a powder inlet, and a powder outlet connected to the discharge conduit. In another aspect of this invention, a venturi transfer pump is mounted in the gun body between the powder inlet and the powder outlet. The venturi pump controls the velocity of the powder flowing from the gun into the spray head.

Powder is supplied from a supply conduit to the powder inlet of the gun body, and then flows from the powder inlet into an expansion chamber portion of the venturi pump within the gun. The supply conduit receives air-entrained solid particulate powder from a feeder pump which is connected to a powder hopper. The supply conduit is preferably formed with a 90° angle or bend so that the powder particles are concentrated by centrifugal force against the outer wall of the bend of the conduit, and are delivered in such a concentrated stream from the supply conduit into the expansion chamber of the venturi transfer pump. The concentration of the powder flow prior to its delivery to the venturi pump in the gun body produces a powder stream within the gun body which is repeatable throughout all conditions of operation of the gun.

A pressure drop is created in the expansion chamber of the venturi pump of the powder spray gun by means of high pressure air injected into the expansion chamber. This pressure drop draws the concentrated powder stream from the supply conduit into the expansion chamber of the venturi transfer pump. The powder stream is pumped from the expansion chamber, into the outlet passageway of the gun. Since the pump is operating on an incoming powder flow which is being supplied in a repeatable distribution or concentration, the pump delivers a consistent flow pattern into the discharge conduit of the gun throughout the operation of the gun.

Additionally, the venturi transfer pump in the gun body permits the velocity of the powder delivered to and spray from the spray head of the gun to be controlled independently of the powder flow rate which is controlled by the feeder pump connected to the powder hopper.

In a further aspect of this invention, the spray head comprises a body portion, and end cap connected to the body portion and a spacer interposed between the body portion and end cap. In a preferred embodiment, the spacer is a flat plate formed with a tapered, pie-shaped cut-out portion which defines the powder discharge slot of the spray head. The powder discharge slot terminates in a spray orifice. The spacer is oriented with respect to the deflector mounted in the discharge conduit such that particulate powder material is directed by the deflector into the pie-shaped cut-out portion of the spacer from which the powder is dispensed in a fan-shaped pattern onto the target surface.

In a further aspect of this invention, the width of the spray pattern emitted from the spray system of this invention may be varied by altering the size and shape of the deflector, the orientation of the deflector relative to the spacer, the width of the powder discharge slot in the spray head which is determined by the thickness of the spacer, and the angle of the pie-shaped cut-out in the spacer. The type of particulate powder material and the size of powder particles sprayed also affect the width of the spray pattern. It has been found that whereas a typical prior art powder spray gun with a slot nozzle produces an effective spray pattern of 12 to 18 inches in width, the powder spray gun of this invention spraying the same powder is capable of producing effective spray patterns varying in width from 18 to 60 inches.

Another advantage of the spray gun of this invention is that the powder particle distribution or density within the spray pattern may be varied if required for a given application. Control of the particle distribution is achieved by altering any one of a number of variables including the angle between the inlet and outlet ends of the supply and/or discharge conduits, the shape of the deflector, the angle between the walls in the spacer formed by the pie-shaped cut-out the thickness of the spacer. Each of these variables have been found to affect the concentration or distribution of powder particles within the spray pattern, and can be altered to obtain different but repeatable powder distribution patterns for different applications.

Additionally, the velocity of the powder stream ejected from the powder discharge slot is variable in the powder spray gun of this invention. Higher velocities of the powder stream are desirable in some applications, such as the spraying of dry adhesives into the non-woven portions of disposable diapers, and lower velocities are desirable in other applications. The line pressure of the air inlet supplying the venturi transfer pump in the gun body can be increased or decreased to change the velocity of the powder flowing into the discharge conduit and then into the spray head. Alternatively, the velocity of the powder sprayed from the spray head can also be varied by substituting spacers of different thickness so that the space or gap between the body portion and end cap of the spray head which defines the powder discharge slot is varied.

DESCRIPTION OF THE DRAWINGS

The structure, operation and advantages of a presently preferred embodiment of this invention will become further apparent upon consideration of the following description, taken in conjunction with the accompanying drawings, wherein.

DETAILED DESCRIPTION OF THE INVENTION

Figure 1:
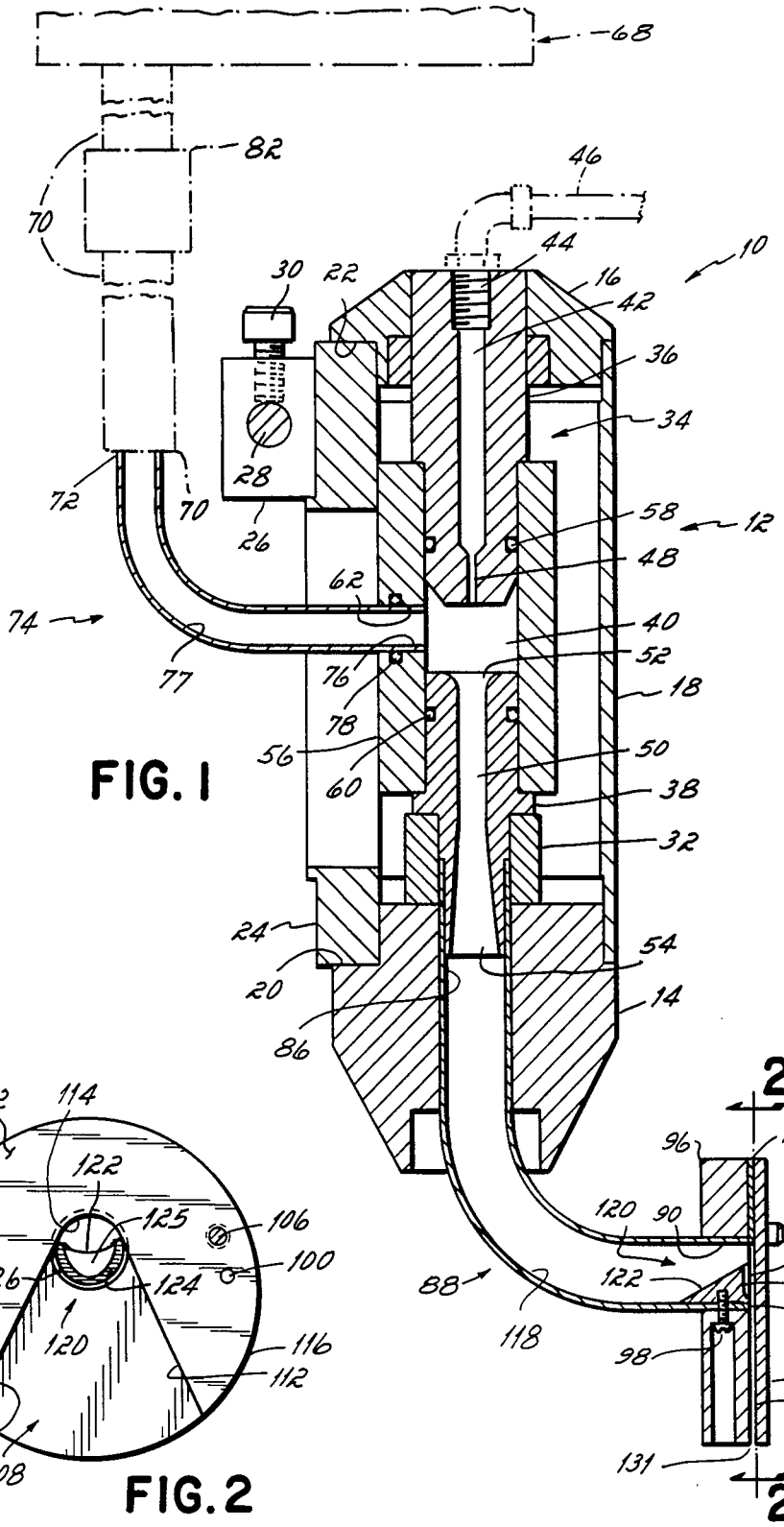
FIG. 1 is a front elevational view in partial cross section of the powder spray gun of this invention.

Referring now to the drawings, the powder spray gun 10 of this invention includes a gun body 12 having a head portion 14, an end cap 16 and a cover plate 18 extending therebetween. The head portion 14 and end cap 16 are each formed with recesses 20, 22, respectively, which support a mounting block 24 having a flange 26. The flange 26 is formed with a throughbore in which a rod 28 can be inserted for mounting the gun 10. A set screw 30 secures the gun 10 to rod 28.

An annular clamping ring 32 is mounted atop the head portion 14 of the gun body 12. Ring 32 clamps around the lower portion 38 of a venturi transfer pump 34 which is supported in the gun body 12. Venturi transfer pump 34 also includes an upper portion 36 and an expansion chamber 40. The upper portion 36 of venturi transfer pump 34 is formed with an air inlet passageway 42 connected at one end by a fitting 44 to a high pressure air line 46. The opposite end of air inlet passageway 42 is formed with a reduced diameter, discharge orifice 48 communicating with the expansion chamber 40. The lower portion 38 of venturi transfer pump 34 includes an outlet passageway 50, coaxial with air inlet passageway 42. Passageway 50 has a venturi throat 52 opening into the expansion chamber 40 and an enlarged end 54 oppposite the venturi throat 52. The upper and lower portions 36, 38 of venturi transfer pump 34 are connected to an annular sleeve 56 in the gun body 12 and sealed thereto by O-rings 58, 60, respectively. The annular sleeve 56 has a bore 62 extending into the expansion chamber 40 which forms the powder inlet of gun body 12.

A source 68 of air-entrained particulate powder material, including a metering pump and powder hopper (not shown), is connected through feed line 70 to the inlet end 72 of a powder supply conduit 74. The outlet end 76 of powder supply conduit 74 is sealed by an O-ring 78 to the wall of the powder inlet bore 62 formed in the sleeve 56.

In a presently preferred embodiment, an electrostatic charging device 82 may be connected to the feed line 70 as shown in FIG. 1. An electrostatic charging device of the type disclosed in U.S. Pat. No. 4,399,945 is suitable for use herein and functions to electrostatically tribocharge the air-entrained solid particulate powder material prior to its introduction through the supply conduit 74 into the gun body 12. If an electrostatic charging device 82 is employed, the gun body 12 and all other parts of the system would be made of non-conductive materials such as plastic. Without the electrostatic charging device 82, all elements of the spray gun 10 could be made from either conductive or non-conductive materials.

The supply conduit 74 is preferably formed with a 90° bend between its inlet and outlet ends 72, 76 to the powder in a concentrated stream along the outer wall 77 of the bend which is repeatable throughout the operation of the powder spray gun 10. The concentrated powder stream is discharged into the expansion chamber 40 through the powder inlet bore 62. A pressure drop is created in the expansion chamber 40 by the high pressure air from line 46 which is ejected through the small diameter discharge orifice 48 of the venturi transfer pump 34 into the relatively large expansion chamber 40. The concentrated powder stream from the supply conduit 74 is sucked or drawn into the expansion chamber 40. The powder is pumped from the expansion chamber 40 through the venturi throat 52 into the outlet passageway 54 which has a much larger diameter than the discharge orifice 48. Since the concentrated powder stream is delivered to expansion chamber 40 of pump 34 in a repeatable pattern of distribution, the pump 34 in a repeatable pattern of distribution, the pump 34 delivers a consistent, repeatable powder flow through outlet passageway 50 into discharge conduit 88.

Referring now to the lower portion of FIG. 1, the lower portion 38 of the venturi transfer pump 34 is secured to the inlet end 86 of a discharge conduit 88. The inlet end 86 is held in place frictionally between ring 32 and the lower portion 38, but is permitted to rotate 360° relative to the gun body 12. In a presently preferred embodiment, the outlet end 90 of discharge conduit 88 is disposed at an angle or bend of approximately 90° relative to the inlet end 86.

A spray head 94 having a body portion 96 is mounted to the outlet end 90 of discharge conduit 88. A pair of pins 100 project outwardly from the face of body portion 96 to support a spacer 102. The spacer 102 is secured to the body portion 96 by a circular plate or end cap 104 which is secured to the body portion 96 by screws 106.

Figure 2:
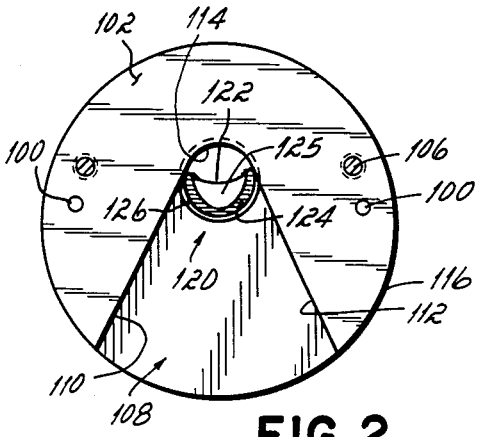
FIG. 2 is a view taken generally along line 2—2 of FIG. 1 showing the powder ejection passageway at the spray head herein.

In a presently preferred embodiment of this invention, the spacer 102 is formed with a pie-shaped cut-out portion 108 having opposed walls 110, 112 which meet at a rounded apex 114 and extend outwardly relative to one another from the apex 114 toward the outer edge 116 of spacer 102. As shown in FIG. 2, the spacer 102 is oriented with respect to the outlet end 90 of discharge conduit 88 such that the rounded apex 114 of the cut-out portion 108 extends along the top portion of the inner circumference of the end 90 of discharge conduit 88. The cut-out portion 108 defines a pie-shaped powder discharge slot 130 which terminates with a spray orifice for discharging powder onto a surface.

A deflector 120 is mounted in the discharge conduit 88 by a set screw 98. The set screw 98 extends into a bore formed in the body portion 96 of spray head 94, through the discharge conduit 88 and into the deflector 120 to mount both the spray head 94 and deflector 120 to the discharge conduit 88. The deflector 120 is wedge-shaped with an angled, upper surface 122, and an upright forward surface 124. Forward surface 124 is positioned slightly inwardly from the outermost edge 126 of outlet conduit 88. In a presently preferred embodiment, the upper surface 122 is flat and the forward surface 124 is formed with a generally concave depression 125 as illustrated in FIG. 2.

The spray gun 10 of this invention functions in the following manner. Air entrained particulate powder material from source 68 is directed by feed line 70 toward the powder supply conduit 74. The particulate powder material may be electrostatically charged by electrostatic charging device 82 prior to entering powder supply conduit 74. The outlet end 76 of powder supply conduit 74 is disposed at approximately a 90° angle or bend with respect to its inlet end 72 to concentrate the particulate powder material against the outer wall 77 of inlet conduit 74 due to centrifugal force. The particulate powder material is therefore introduced through powder supply conduit 74 into the expansion chamber 40 of the venturi transfer pump 34 in a concentrated stream. This concentration of the powder flow prior to the pump is the first step in distributing the powder so that it can eventually be sprayed in a repeatable, consistent pattern from the spray gun 10.

The pressure drop in expansion chamber 40 draws the concentrated stream of particulate powder material into chamber 40 from which it is pumped into the venturi throat 52 of outlet passageway 50, passes through enlarged end 54, and is delivered into the discharge conduit 88. Since a consistent powder flow is delivered into the expansion chamber 40 of the pump 34, a repeatable, consistent powder flow is discharged from the pump 34 into the discharge conduit 88.

Once in the discharge conduit 88, the particulate powder material is formed into a concentrated stream. This is accomplished by the 90° bend between inlet end 86 and outlet end 90 which concentrates the particulate powder material against the outer wall 118 of the bend in discharge conduit 88. The concentrated stream of particulate powder material engages the upper surface 122 of deflector 120, impacts end cap 104 of the spray head 94 and then flows downwardly along the concave forward surface 124 of deflector 120 into the pie-shaped powder discharge slot 130.

It has been determined that a flat face 124 on deflector 120 produces a spray pattern having tails, or fatty edges. By providing a concave depression 125 on the front face 124, relief was provided for more powder to flow into the middle of the area within apex 114 which results in the powder feathering out more uniformly across the pie-shaped powder discharge slot 130.

The size and shape of slot 130 are defined by the angled walls 110, 112, rounded apex 114 and the thickness of spacer 102. Slot 130 terminates in an arcuate, elongated discharge orifice 131. The plane within which slot 130 lies is oriented at an angle of about 90° relative to the longitudinal centerline of outlet end 90 of discharge conduit 88.

Figure 3:
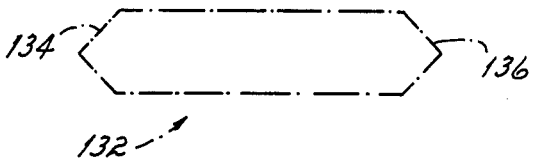
FIG. 3 is a view of the spray pattern obtained from the powder spray gun herein.
Figure 4:
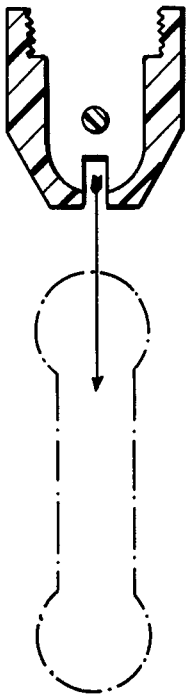
PRIOR ART FIG. 4
FIG. 4 is a schematic view of a prior art powder spray gun having a slot nozzle, and the spray pattern it produces.

The geometry of the slot 130 and deflector 120, as well as the structure of the gun 10 described above which provides a consistent, repeatable flow at the outlet end 90 of discharge conduit 88, produce a wide uniform spray pattern 132 (shown in FIG. 3) which is not only uniform across its length, but also has tapered ends 134, 136 which allow adjacent patterns to blend together without streaking. This is in contrast to the barbell-shaped spray pattern of the prior art spray guns as shown in FIG. 4.

The particle concentration or distribution within the spray pattern produced by gun 10 can be varied to accommodate particular applications by changing any one of a number of variables in the spray gun 10. For example, the powder spray pattern 132 can be altered by changing the angles between the ends of either the inlet conduit 74 or outlet conduit 88. A change in these angles will change the degree of concentration of the powder material along the outer walls 77 and 118 formed by the bends in conduits 74, 88, respectively.

Additionally, the particle density within the spray pattern 132 can be altered by varying the geometry of deflector 120. For example, a concave-shaped upper surface 122 of deflector 120 would direct the concentrated particle stream toward the center of cut-out portion 108, whereas a convex-shaped upper surface 122 would direct the concentrated particle stream outwardly toward the edges of the inner wall 118 of discharge conduit 88 and away from the center of cut-out portion 108. The size of the angle between the walls 110, 112 of cut-out portion 108 as well as the thickness of spacer 102 also affect the distribution of powder and shape of the spray pattern 132. Any of these variables may be altered, as desired, to obtain a particular concentration or density of particulate powder material upon a target surface.

The width of the spray pattern 132 is also variable, and widths of up to about 60 inches have been obtained while maintaining desired particle density or concentration. The width of the spray pattern is dependent upon the thickness of spacer 102 which controls the width of powder ejection passageway 130, and the angle between the tapered walls 110, 112 of the powder discharge slot 130, as well as the geometry of deflector 120.

The velocity at which the particulate powder material is discharged from the powder ejection passageway 130 is also variable with the spray gun 10 of this invention. This is achieved in either one of two ways. First, the line pressure of air line 46 supplied to the venturi transfer pump 34 can be varied for a powder discharge slot 130 of given width to vary the velocity at which particulate powder material is ejected from slot 130. The larger the pressure, the greater the velocity. Alternatively, the powder stream velocity can be varied by altering the thickness of the spacer 102 interposed between the body portion 96 and end cap 104 of spray head 94, which, in turn, changes the width of powder discharge slot 130. If the width of powder discharge slot 130 is reduced, the velocity of the air-entrained particulate powder material is increased for a given pressure in air line 46. The reverse is alos true; that is, the velocity of the particulate powder material in slot 130 is decreased by increasing the width of slot 130 for a given pressure in air line 46.

While the invention has been described with reference to a preferred embodiment, it will be understood by those skilled in the art that various changes may be made to the preferred embodiment disclosed without departing from the scope of the invention.

In addition, many modifications could be made to adapt a particular situation or material to the teachings of the invention without departing from the scope thereof. For example, as mentioned, the geometry of deflector 120 could be altered, and various spacers 102 could be employed having different thicknesses and/or different angles between walls 110, 112 of cut-out portion 108. Additionally, the deflector 120 could be omitted from the discharge conduit 88 or repositioned 180° from its position in the preferred embodiment disclosed with better uniformity of particle distribution within a spray pattern than obtained by prior art spray guns. Further, although the powder discharge slot 130 is oriented at an angle of about 90° relative to the outlet end 90 of discharge conduit 88, the slot 130 could be oriented at another angle relative thereto while still maintaining desired uniformity in the powder spray pattern. Other variations of the invention as described in more detail hereinabove can also be employed.

Therefore, it is intended to be understood that the invention is not limited to the particular embodiment disclosed as the best mode presently contemplated for carrying out this invention; instead, the invention is intended to include all embodiments falling within the scope of the appended claims.

What is claimed is:

1. A powder spray gun for spraying air-entrained particulate powder material comprising:

a gun body having a powder inlet and a powder outlet;

means for connecting said powder inlet of said gun body to a source of air-entrained particulate powder material;

a conduit having an inlet end connected to said powder outlet of said gun body for receiving particulate powder material and an outlet end, said conduit having a bend between said inlet end and said outlet end, said bend having an outer wall on one side of said conduit, the particulate powder material in the course of flow through said conduit being concentrated in a powder flow stream along said outer wall of said bend in said conduit;

a spray head mounted to said outlet end of said conduit, said spray head being formed with a powder discharge slot terminating in a powder spray orifice;

deflector means mounted within said conduit for contacting and directing said concentrated stream of particulate powder material into a predetermined portion of said powder discharge slot of said spray head and out said powder spray orifice for dispersion onto a substrate.

2. The powder spray gun of claim 1 further comprising a spray system including a means for electrostatically charging powder prior to its delivery to the gun.

3. The powder spray system of claim 2 wherein said electrostatic charging means for said powder is a tribocharging device.

4. The powder spray gun of claim 1 in which the concentrated stream of particulate powder material is ejected from said conduit into a powder discharge slot formed in said spray head, said powder discharge slot terminating in said powder spray orifice.

5. The powder spray gun of claim 1 in which said powder discharge slot lies in a plane which is oriented at an angle of about 90° relative to the outlet end of said conduit.

6. The powder spray gun of claim 1 further including a supply conduit having an inlet end communicating with the source of air-entrained powder and an outlet end connected to said powder inlet, said supply conduit having a bend between said inlet end and said outlet end, the particulate powder material being concentrated in a powder flow stream along an outer wall of said bend in said supply conduit before being discharged through said powder inlet into said gun body.

7. The powder spray gun of claim 1 further including a venturi transfer pump mounted to said gun body, said venturi transfer pump comprising:

an expansion chamber connected to said powder inlet;

an air inlet passageway connected to a source of high pressure air and having a discharge orifice communicating with said expansion chamber; and an outlet passageway having a venturi throat communicating with said expansion chamber.

8. The powder spray gun of claim 1 in which said conduit includes an inlet end connected to said powder outlet and an outlet end connected to said spray head, said conduit having a bend of approximately 90° between said inlet end and said outlet end, the particulate powder material being concentrated in a powder flow stream along said outer wall of said bend of said conduit before being discharged into said spray head.

9. The powder spray gun of claim 1 in which said spray head comprises a body portion, an end cap, and a spacer interposed between said body portion and said end cap.

10. The powder spray gun of claim 9 in which said spacer comprises a plate formed with a cut-out portion having walls connected together at an apex and extending outwardly from said apex at an angle from one another, said tapered cut-out portion defining said powder discharge slot.

11. The powder spray gun of claim 10 in which said plate has a thickness, said thickness of said plate forming a space between said body portion and said end cap, said space defining the width of said powder discharge slot.

12. The method of spraying particulate powder material from a spray gun comprising:

moving particulate powder material through a conduit having a bend to distribute the particulate powder material in a concentrated stream along the outer wall of said bend in said conduit;

impacting the concentrated stream of particulate powder material against a deflector mounted within said conduit in the path of said concentrated stream;

guiding the particulate powder material in a concentrated stream from said deflector into a predetermined portion of a powder discharge slot in a spray head of the spray gun for dispersion onto a substrate.

13. The method of varying the distribution of powder material within a spray pattern from a powder spray gun, comprising:

moving particulate powder material through a conduit having a bend to distribute the particulate powder material in a concentrated stream along the outer wall of said bend in said discharge conduit;

impacting the concentrated stream of particulate powder material against a deflector mounted within said conduit in the path of said concentrated stream;

guiding the particulate powder material in a concentrated stream from said deflector into a predetermined portion of a powder discharge slot formed in a spray head mounted to said conduit, and through a powder spray orifice of said spray head for dispersion in a spray pattern onto a surface;

varying the shape of said deflector to direct the concentrated stream of particulate powder material into a portion of said powder discharge slot in said spray head different from said one predetermined portion to vary the spray pattern of powder dispersed through said powder spray orifice onto the surface.

14. The method of claim 13 in which said slot is defined by a cut-out portion formed in said spray head, said cut-out portion having a width and a pair of walls connected together at an apex, said walls extending outwardly from said apex at an angle relative to one another, said method further comprising the step of:

varying said width of said cut-out portion.

15. The method of claim 14 further including the step of:

varying said angle between said walls of said cut-out portion.

16. The method of claim 13 in which said spray gun includes a supply conduit for supplying air-entrained particulate powder material to said spray gun, and a discharge conduit for supplying air-entrained particulate powder material to said spray head, said supply conduit and said discharge conduit each having inlet and outlet ends, said method further comprising the step of:

varying the angle between said inlet end and said outlet end of at least one of said supply conduit and said discharge conduit.

17. The powder spray gun of claim 1 in which said deflector means is a plate mounted to said conduit in the path of said concentrated stream of particulate powder material, said plate being formed with a concave upper surface which directs said concentrated stream of particulate powder material into the center portion of said powder discharge slot for dispersion in a uniform spray pattern onto a substrate.

* * * * *